United States Patent [19]
Lewis, Jr.
[11] 4,230,186
[45] Oct. 28, 1980

[54] SIMPLIFIED SUBSEA PRODUCTION WELLHEAD

[75] Inventor: Harry R. Lewis, Jr., Aberdeen, Scotland

[73] Assignee: Standard Oil Company (Indiana), Chicago, Ill.

[21] Appl. No.: 968,236

[22] Filed: Dec. 11, 1978

[51] Int. Cl.³ ..... E21B 7/12

[52] U.S. Cl. ..... 166/342; 166/94; 175/7; 405/169

[58] Field of Search ..... 166/335-368, 166/92, 94; 175/5, 7; 405/169, 170

[56] References Cited

U.S. PATENT DOCUMENTS

| | | | |
|---|---|---|---|
| 2,755,863 | 7/1956 | Stansbury, Jr. et al. | 166/94 X |
| 3,373,807 | 3/1968 | Fischer et al. | 166/342 |
| 3,741,296 | 6/1973 | Murman et al. | 166/338 |
| 3,934,647 | 1/1976 | Bokenkamp | 166/352 |
| 3,953,982 | 5/1976 | Pennock | 405/170 |
| 3,981,369 | 9/1976 | Bokenkamp | 175/85 |
| 4,147,221 | 4/1979 | Ilfrey et al. | 166/339 |
| 4,167,215 | 9/1979 | Thorne | 175/7 X |

*Primary Examiner*—James A. Leppink
*Assistant Examiner*—Richard E. Favreau
*Attorney, Agent, or Firm*—John D. Gassett

[57] ABSTRACT

A simplified subsea production wellhead which permits (1) pump-down tool operations for routine well maintenance and (2) vertical entry to the wellbore for major workover operations. The wellhead can be lowered by the production pipeline to a wellhead site on the sea floor. The production wellhead includes a diverter spool for releasably attaching to a subsea well. Pump-down tools can be used with the diverter spool. If vertical entry of the subsea well is required, the diverter spool can be released, raised and moved horizontally to one side of the subsea well, giving vertical entry. After workover operations, the diverter spool is again moved over the subsea well and reattached.

6 Claims, 9 Drawing Figures

SIMPLIFIED SUBSEA PRODUCTION WELLHEAD

BRIEF SUMMARY OF THE INVENTION

This invention relates especially to the completion of subsea oil or gas wells drilled in the sea floor. It concerns a simplified production wellhead assembly which, in addition to normal production operations, would permit (1) pump-down tools (PDT) operations for routine well maintenance and also (2) vertical entry to the wellbore for major workover operations from a floating rig positioned above the subsea well. The assembly includes a frame which is attached by hinges to a pair of guide funnels which are to be run onto two guideposts of a conventional guide frame assembly previously installed at the wellhead site on the sea floor. Within the frame is a simplified wellhead and flow line loops for PDT operations. The wellhead assembly contains a remotely operable hydraulic wellhead connector releasably attached to a previously installed wellhead hub and a production diverter spool which is attached to the wellhead connector. The production wellhead assembly is lowered vertically from the pipeline lay barge by paying out a pipeline attached to the assembly and particularly the diverter spool. The funnels are positioned over the previously installed guide posts using guidelines or sonar and t.v. techniques which are well known. Once the guide funnels are positioned over the guide post, they are latched thereto. The wellhead assembly is then rotated to a horizontal position as pipeline laying progresses. After the production wellhead assembly has been rotated to a horizontal position, the wellhead connector is connected to the previously installed wellhead hub.

The tool assembly is then in position for production and/or any necessary PDT operations. Occasionally, it will be necessary to work over the well by direct entry from a vessel. This is accomplished by disconnecting the diverter spool from the wellhead hub, raising the simplified wellhead and moving it horizontally out of the way. The flow line loops are long enough to give the necessary flexure without overstressing them. An extension sub with hydraulic connector is then lowered onto the wellhead hub to enable the use of a blowout preventer stack. Entry to the well is effected through the blowout preventer stack. When the work is completed, the blowout preventer stack and extension sub are removed and the production wellhead would be repositioned over the wellhead hub and reconnected.

DRAWINGS

DETAILED DESCRIPTION

Figure 1:
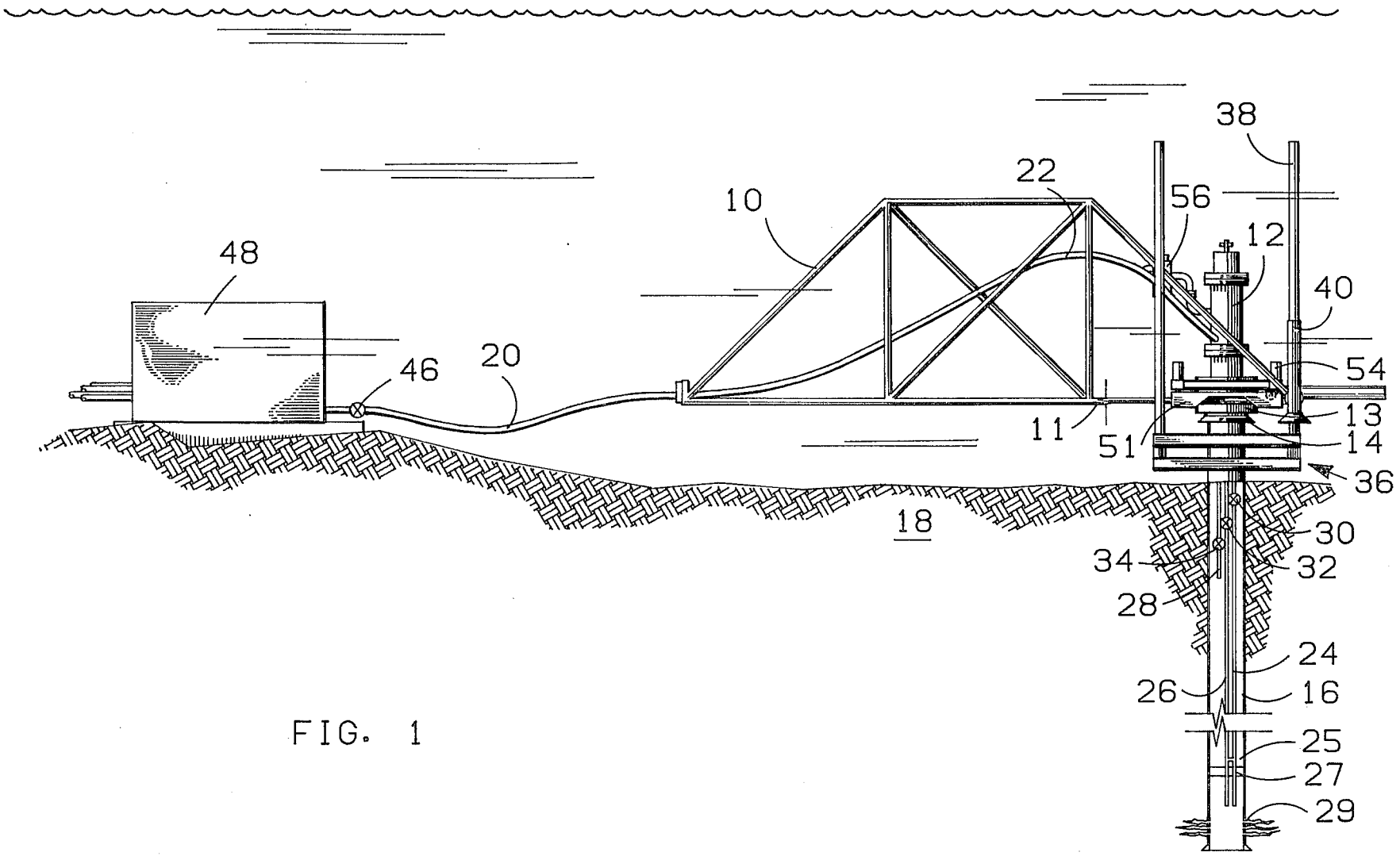
FIG. 1 illustrates the production wellhead assembly in position on a subsea well and connected to a subsea manifold.

Attention is first directed to FIG. 1 which shows a production wellhead assembly in place on a wellhead hub at the bottom of a body of water. Shown thereon is a frame 10 having a diverter spool 12, which is connected by connector 13 to well hub 14 which is positioned on top of sub-sea well 16, which is drilled in the sea floor 18. A flow line bundle 20 is connected to flow line loops 22, which extend into diverter spool 12 to provide fluid communication from manifold 48 to various tubing strings 24, 26 and 28 suspended in well 16. These tubing strings have respectively therein, master valves 30, 32 and 34 which are remotely operable.

A guide frame 36 having guide posts 38 is provided for well 16. The production wellhead assembly has a guide funnel 40, which has been positioned over guidepost 38 and attached thereto by suitable mechanical or other type connector.

Figure 2:
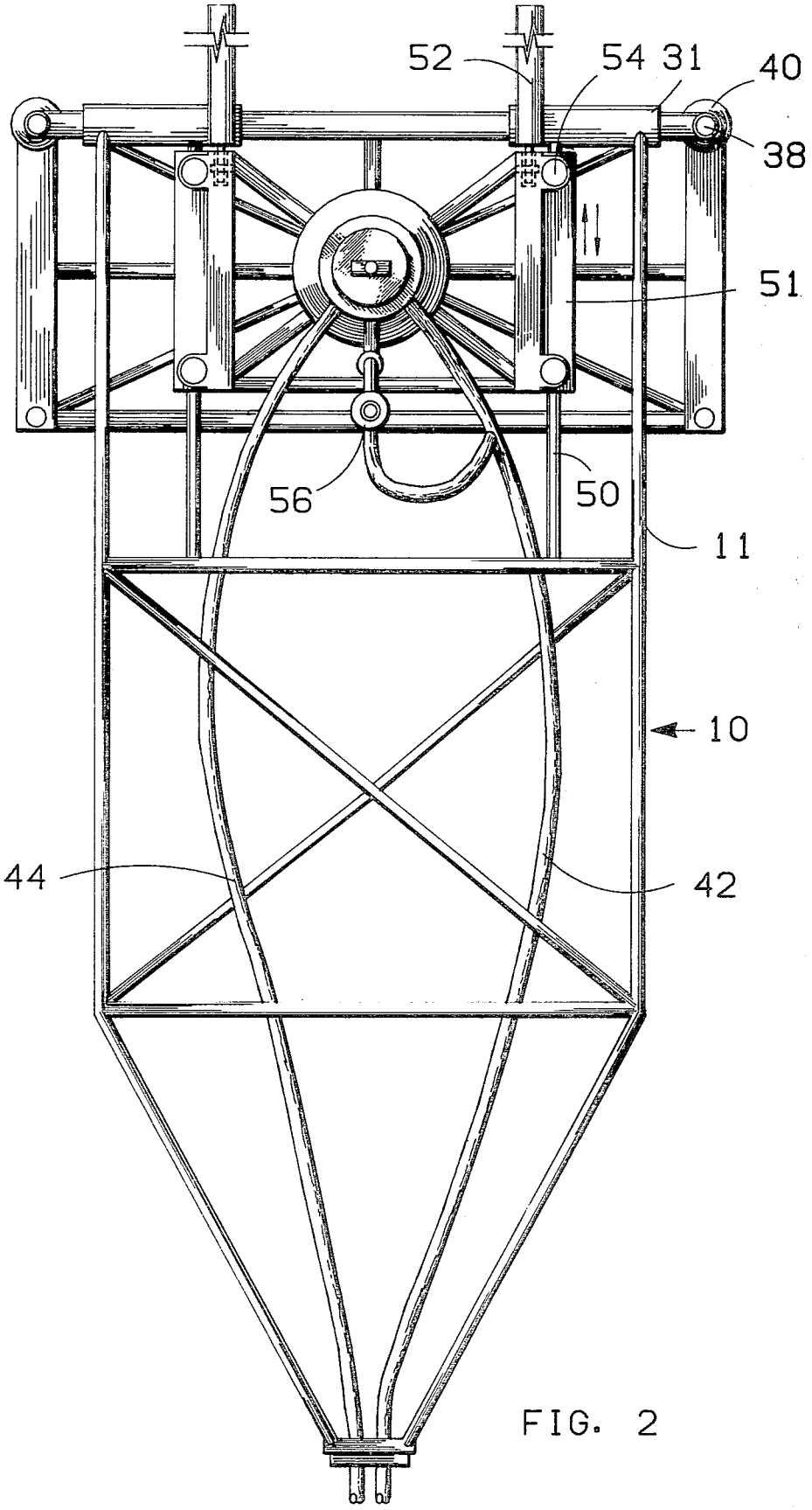
FIG. 2 illustrates a plan view of the production wellhead assembly of FIG. 1.

Flow line bundle 20 is in effect many lines and as shown in FIG. 2 comprises lines 42 and 44. Each of these lines has one or more master valves 46 which are connected to a manifold header module 48. One subsea manifold header is shown in U.S. Pat. No. 4,015,660, issued Apr. 5, 1977, entitled Subsea Oil and Gas Production Manifold System, Harry R. Lewis, Jr. inventor.

Figure 3:
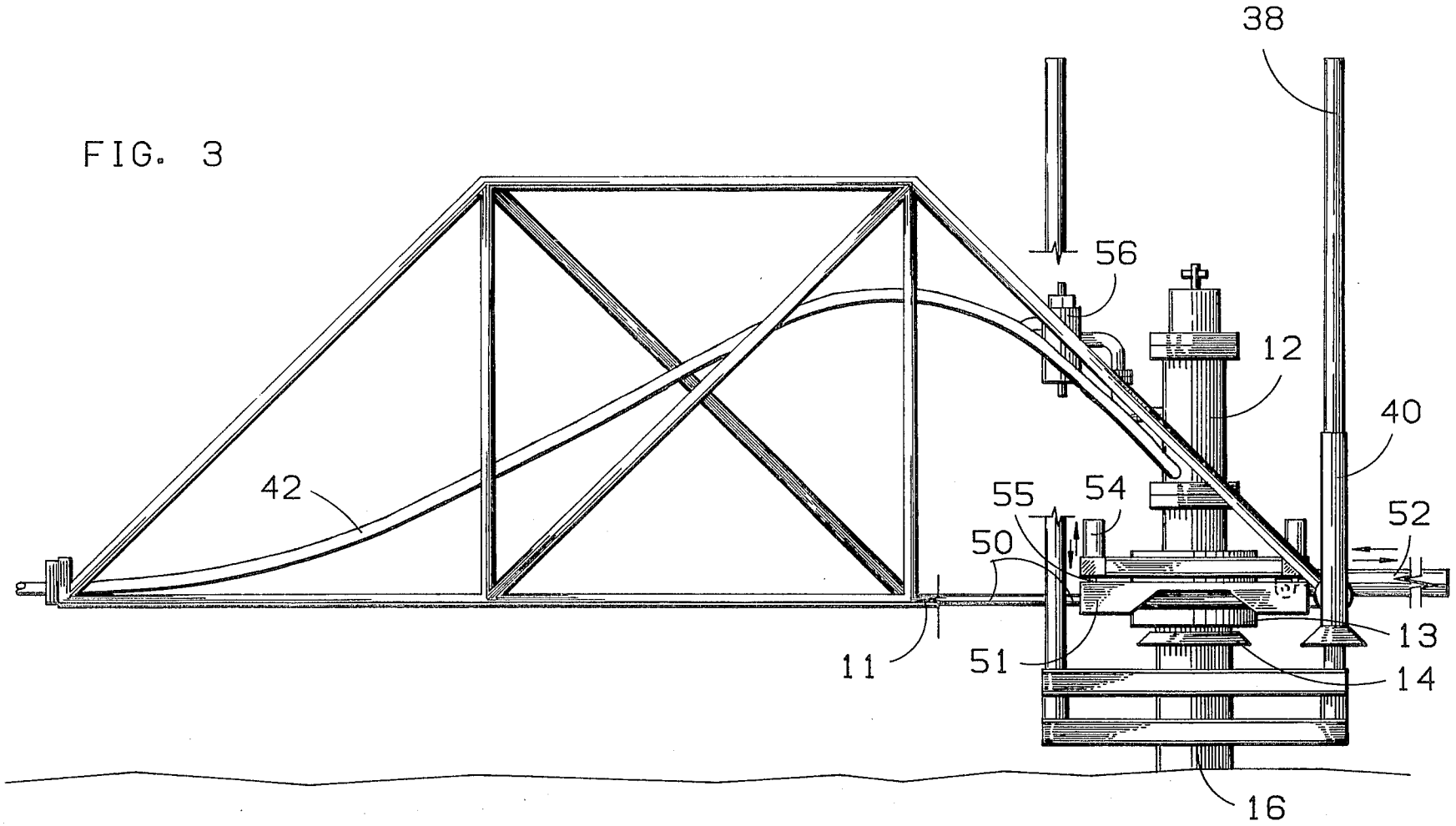
FIG. 3 is similar to FIG. 2 except it shows a side view of the producing wellhead assembly.

The diverter spool 12 is supported by means such that it can be moved horizontally and vertically within limits the guide frame 10. A part of member 11 of frame 10 has been cut away in the side view Figures to more easily show the support means. The diverter spool 12 is mounted on a sub frame 51 or support means which includes slide rails 50, on which the sub frame is movable in a horizontal direction as indicted in FIGS. 2 and 3 by the arrows by hydraulic rams 52. Sub frame 51 is movable vertically as indicated in FIG. 2 within limits by jacks 54 having rams 55. Hydraulic rams 52 and jacks 54 are thus reversible, i.e., they can be extended or retracted and can be operated remotely as from a floating vessel. A tubing/annulus crossover means 56 is provided from diverter 12 to tubing 42. This, of course, together with the tubing 42 and 44 is useful in PDT operations in a known manner. FIG. 3 is similar to FIG. 2 except it shows a side view of the producing mode in larger scale than in FIG. 1. It shows a well connector connected to the hub of well 16 and producing operations are then conducted through flow lines 42 and any workover operations that can be conducted with pump-down tools are also conducted through the flow lines with the use of the tubing annulus cross over 56 in the usual manner. It is to be noted that tubing strings 26 and 24 are provided with an H member 25 (shown in FIG. 1) at the lower end thereof, so that PDT operations can be conducted. It is also noted that the lower end of the tubing strings 24 and 26 open below a packer 27. Well 16 can be completed in the usual manner using conventional casing strings and conventional perforations as indicated at 29.

Figure 4:
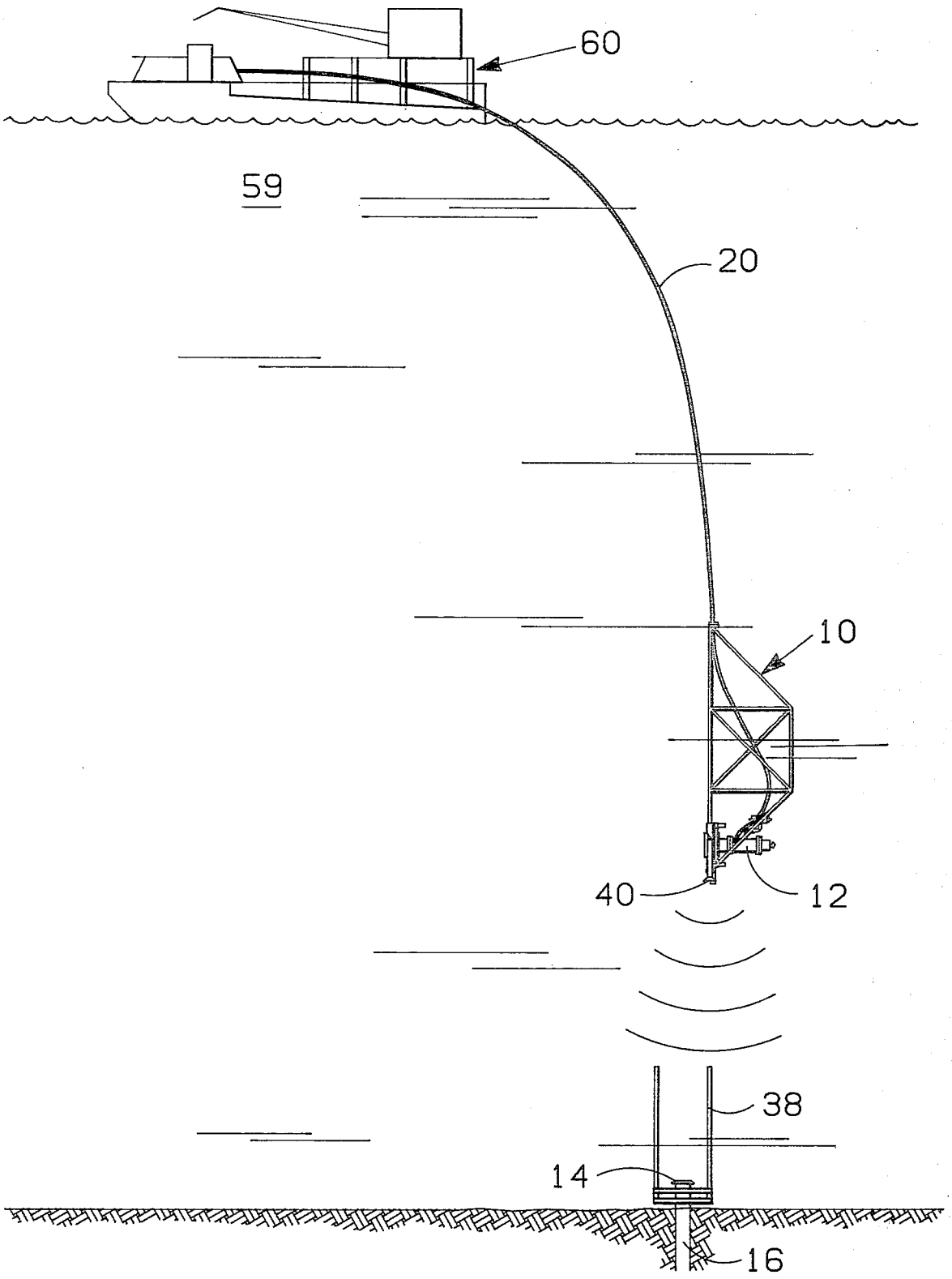
FIG. 4 is a schematic view showing the installation of the production wellhead assembly.

I have just discussed the production wellhead assembly and its operation when it is in position on the sea floor 18. Attention will now be directed toward an explanation of the installation of the production wellhead. Attention is next directed primarily to FIGS. 4 and 5. This illustrtes a pipe lay barge 60 floating on the body of water 59. Suspended from lay barge 60 is flow line bundle 20 which has attached to the lower end thereof the simplified wellhead assembly including frame 10 having diverter spool 12 and guide funnel 40. In the position of FIG. 4, the assembly 10 has been rotated about the axis of hinge 31 so that guide funnel 40 is in a vertical position. The production wellhead assembly and guide funnel are then lowered by paying out line 20. The wellhead assembly and guide funnel are directed by sonar location signal or other known means and is guided to the conventional guide post 38 which has previously been installed. This operation could occur with a drilling rig on location if desired.

Figure 5:
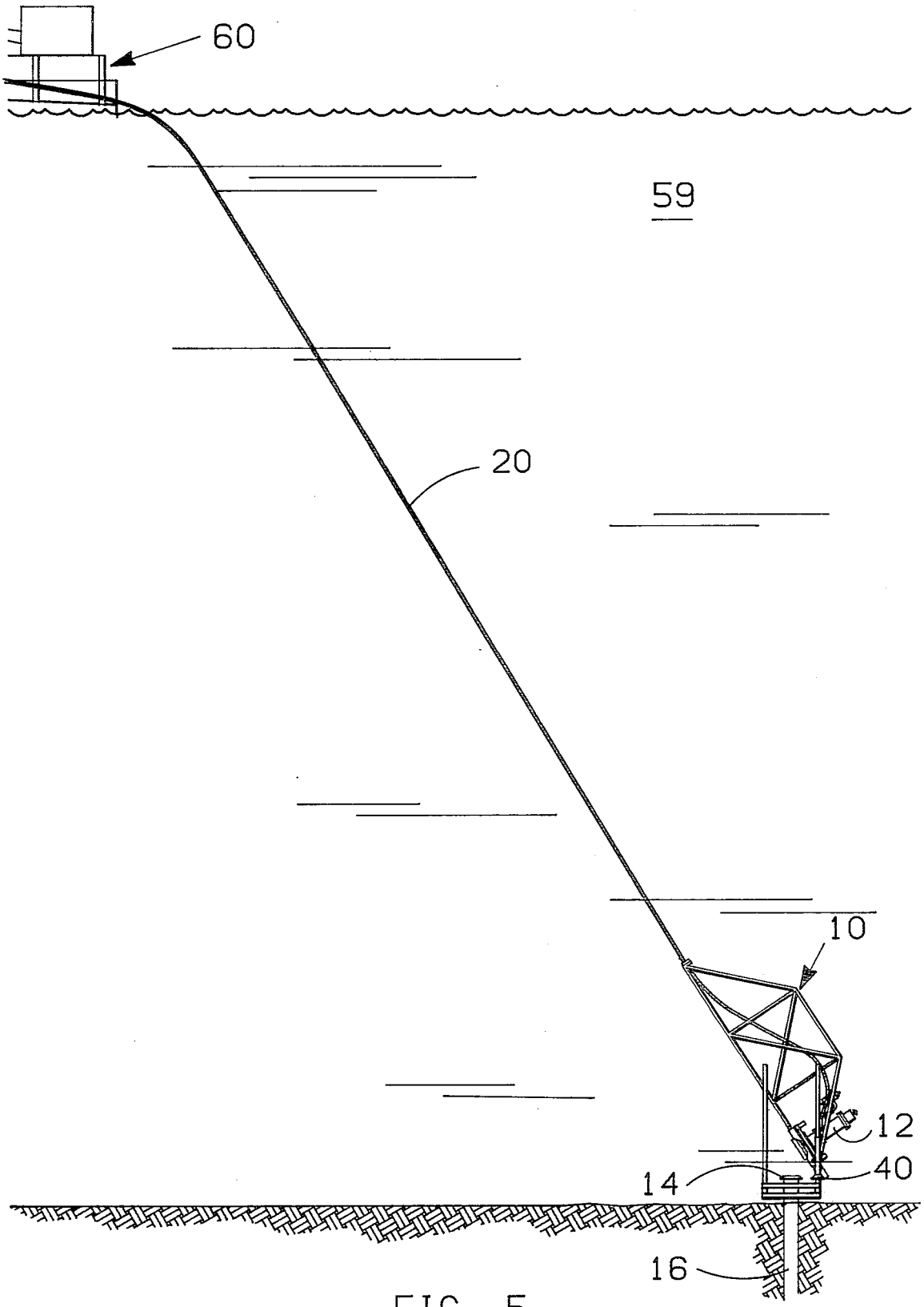
FIG. 5 is similar to FIG. 4 except in this case the production wellhead assembly has been attached to the guideframe and rotated about 45°.

FIG. 5 is an installation schematic drawing showing a further advancement of the installation operation. As shown in FIG. 5 the production wellhead assembly has been lowered so that the guide funnel 40 has been positioned over guide post 38 and latched there by suitably mechanical means not shown. Pipe is continually being added to flow line bundle 20 to increase this length and pipeline lay barge 60 is moved away from the wellhead. In doing this, tension is applied to the flow line bundle 20 and the production wellhead assembly is rotated about hinges 31 until the frame is in the horizontal position as illustrated in FIG. 1. The production wellhead assembly 12 is supported on sub frame 51 which is supported from the main frame 10 by jacks 55 which are remotely operable to extend or retract. This will thus lower or raise the wellhead assembly 12. When frame 10 is horizontal, the jacks 54 are operated so that the connector 13 on the bottom of production wellhead 12 is lowered into position over the wellhead hub 14. The connector is actuated to form a fluid type seal with the wellhead. The connector can be supplied commercially and can be similar to the Auto Lock Connector provided commercially by Armco National Supply Company, P.O. Box 9163, Houston, TX 77011. The well is now in position for the performance of normal operations.

Figure 6:
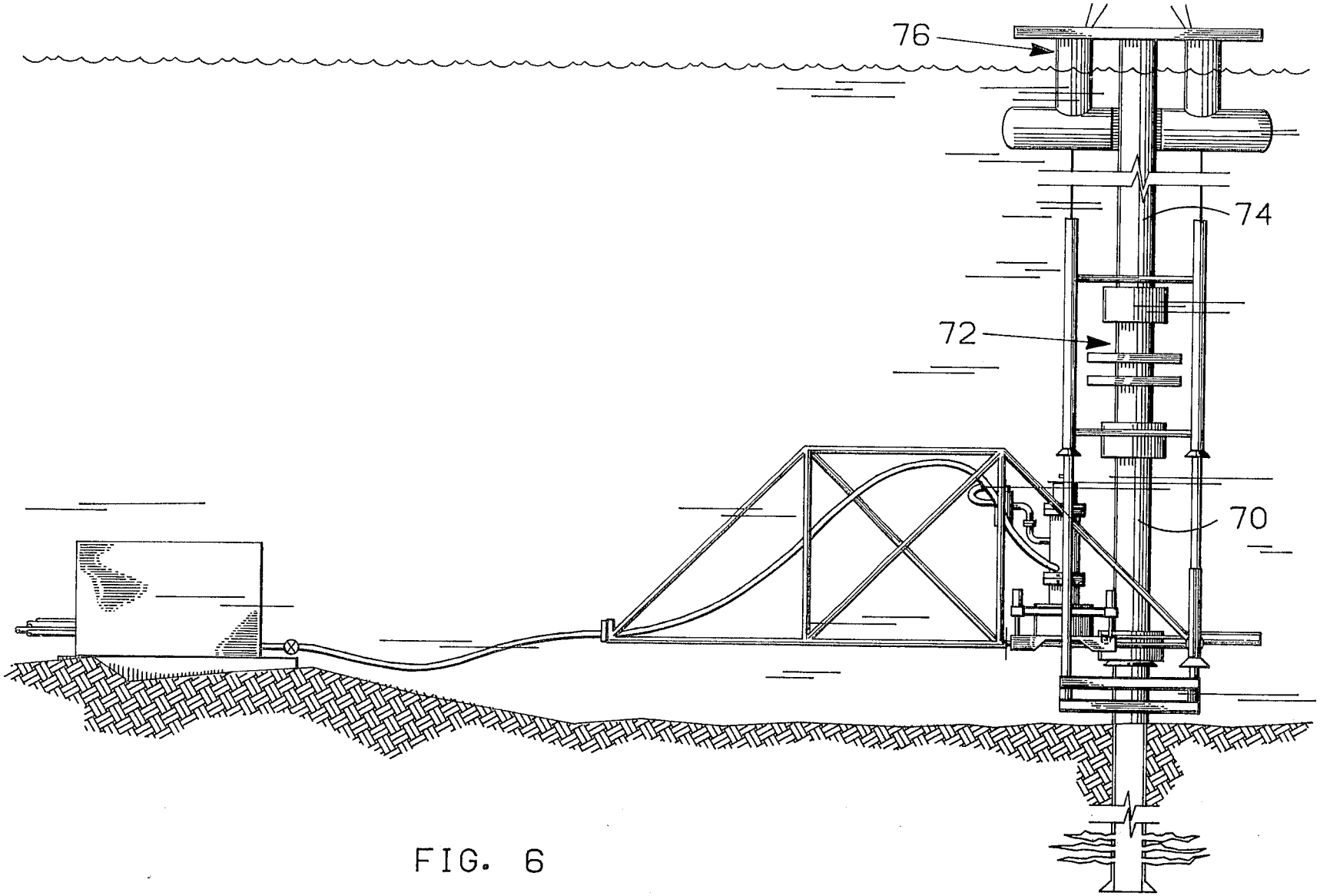
FIG. 6 is a schematic view showing apparatus permitting workover operations from a floating vessel.
Figure 7:
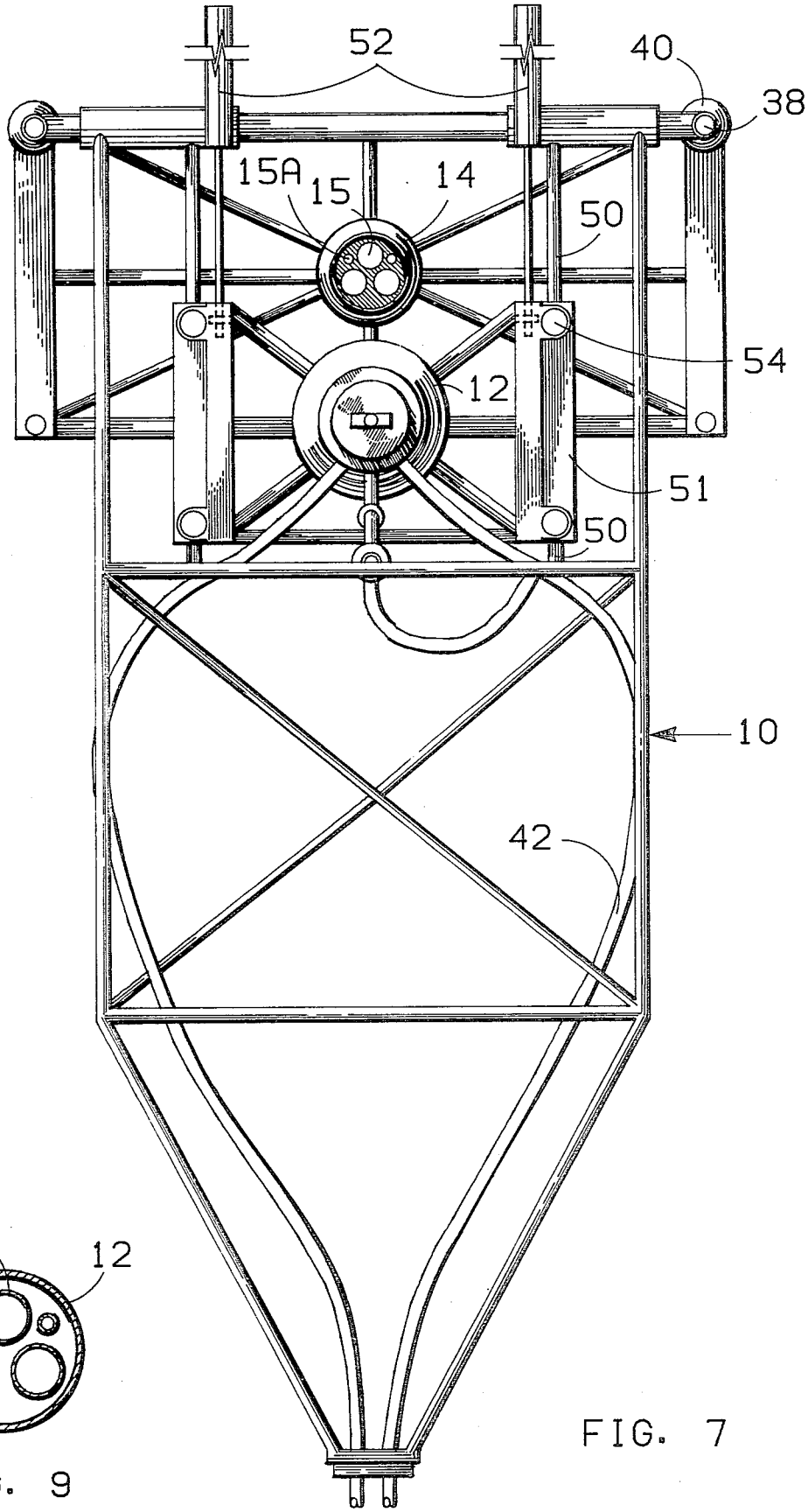
FIG. 7 illustrates a plan view of the position of the production wellhead in the workover mode.
Figure 8:
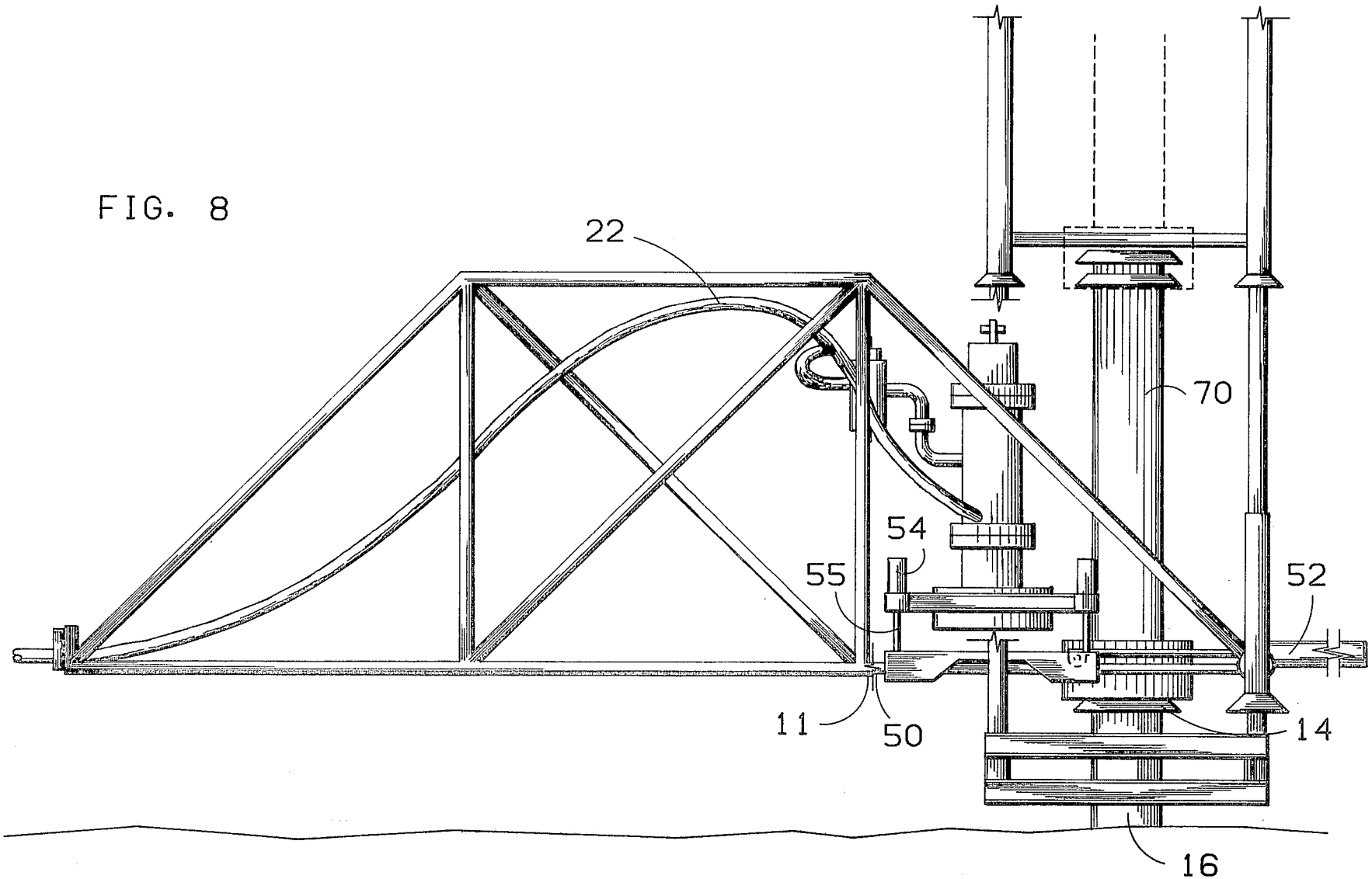
FIG. 8 illustrates a side view of the simplified production wellhead in the workover mode.

Many times, it becomes necessary to enter the full bore of the well such as when it may be required to pull tubing. Thus, when workover operations are required which cannot be conducted by PDT operations, the production wellhead must be removed from the well hub so that the vertical entry can be made into the well bore. Attention is directed to FIGS. 6, 7 and 8 to illustrate this. The well is shut-in by remotely closing valves 30, 32 and 34 or otherwise "killing" the well using recognized oilfield techniques such as circulation of weighted fluids to overbalance downhole pressure.

Figure 9:
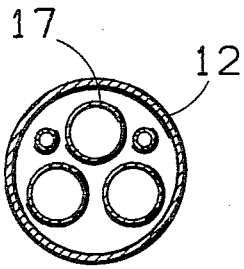
FIG. 9 illustrates a simplified bottom view of a diverter spool of the wellhead assembly showing stab stubs.

The wellhead 12 has been moved horizontally from the wellhead hub 14. This is accomplished by essentially three steps after the well has been "killed", or valves 30, 32 and 34 closed. Connector 14 is remotely disconnected from wellhead hub 16. Then, jacks 55 are actuated to lift the lower end of the connector 13 above the upper end of the well hub 14. Then, hydraulic rams 52 are actuated to move the production wellhead to the position shown in FIGS. 6, 7 and 8. The space above well hub 16 is now clear. It is to be noted that well hub 14 has three port means 15 and two control ports 15A. As shown in FIG. 9 diverter spool has a stab stub 17 for each such port means. An extension sub 70 is next lowered and connected onto well hub 14. This permits the blowout preventer stack 72 to be attached to the upper end of the extension sub 70. Then a marine riser 74 is lowered from a workover vessel 76 in a conventional manner and suitable workover operations are then conducted.

It is to be noted that flow line loops 22 are sufficiently long to make the necessary flexure without overstressing during the movement of the production wellhead 12.

After workover operations have been completed from vessel 76, the blow out stack 72, riser 74 and extension sub 70 are removed. After the removal of this equipment, the production wellhead assembly is moved horizontally till it's over the well hub 14 and then moved vertically until it engages it. Then the connector on the lower end of the diverter spool 12 is reconnected to the well hub 14.

While the above embodiments have been described in detail, it is possible to produce various modifications thereof without departing from the spirit or the scope of the invention.

What is claimed is:

1. A production wellhead means for use with a subsea well which comprises:
   - a frame structure,
   - a sub structure;
   - a diverter spool for attaching to a subsea well and having a longitudinal axis and attached to said sub structure;
   - support means for supporting said sub structure from said frame structure, said support means including means for moving the said diverter spool in a direction along its longitudinal axis with respect to said frame structure and means for moving said diverter spool with respect to said frame structure in a direction substantially perpendicular to said axis of said diverter spool.

2. A production wellhead means as defined in claim 1 including flow passages through said diverter spool from its base to the exterior of said diverter spool and a flow line pipe loop from each said support means to a fixed point on said frame structure, said pipe loops being of sufficient length to give flexure without overstressing when said diverter spool is moved with respect to said frame structure.

3. A production wellhead means for use with a subsea wellhead hub having port means therein, each connected to a tubing string suspended in a wellbore beneath said hub comprising:
   - a guide frame attached to said wellhead hub and having at least two vertical guide posts;
   - a frame structure having a hinge means for mounting over said two guide posts and for rotating said frame structure about said hinge means;
   - a sub structure supported from said frame structure;
   - a production diverter spool and having a stab stub for each said port means of said well hub;
   - means to remotely releasably connect said diverter spool to said well hub;
   - supporting means supporting said diverter spool from said sub structure and including means to move said sub structure in a direction substantially perpendicular to the axis of said hinge means;
   - at least two flow line pipe loops from at least two of said port means to a point on said frame structure, the length of each said flow line pipe loop sufficient to give the necessary flexure without overstressing and a cross over tubing connecting one of said port means to one of said flow pipe loops.

4. A method of performing operations on a subsea well provided with a well hub and a guide frame at the sea floor which comprises:

lowering a production wellhead assembly unit from a barge by paying out a flow line, said wellhead assembly means having a guide funnel, and a production diverter spool hingely connected to said guide funnel, and at least one port means in said diverter spool connected to said lowering pipe line;

guiding said wellhead assembly means while lowering by use of said flow line so that said guide funnel engages said guide frame;

moving said barge in a direction away frm the location of said subsea well and paying out said flow line to cause said frame to rotate about said hinge means until it lies on the ocean floor with said diverter spool in an upright position positioned over said well hub;

sealingly connecting said diverter spool to said well hub and performing production operations through said diverter spool and said flow line.

5. A method as defined in claim 4 including the steps of: disconnecting said diverter spool from said well hub and moving said diverter spool to an offset position with respect to said well hub while maintaining said wellhead assembly connected to said guide frame;

then conducting workover operations through said well hub from a vessel positioned above said well.

6. A method as defined in claim 5 including the step of connecting a riser pipe between said well hub and a floating vessel and performing workover operations through said riser pipe, and thereafter removing said riser pipe and repositioning said diverter spool on said well hub an connecting the two and producing fluid through said diverter spool.

* * * * *

UNITED STATES PATENT OFFICE

CERTIFICATE OF CORRECTION

PATENT NO. : 4,230,186

DATED : October 28, 1980

INVENTOR(S) : Harry R. Lewis, Jr.

It is certified that error appears in the above-identified patent and that said Letters Patent are hereby corrected as shown below:

Column 2, line 33 - "inside" has been omitted at end of line.

Column 3, line 1 - "illustrtes" should read --illustrates--;

line 19 - "suitably" should read --suitable--;

line 61 - "hub 16" should read --hub 14--.

Column 4, line 68 - "flow pipe loops" should read --flow line pipe loops--.

Column 6, line 16 - "an" should read -- and --.

Signed and Sealed this

*Twelfth* Day of *May 1981*

[SEAL]

*Attest:*

RENE D. TEGTMEYER

*Attesting Officer*

*Acting Commissioner of Patents and Trademarks*